US005778793A

United States Patent [19]

Mello et al.

[11] Patent Number: 5,778,793

[45] Date of Patent: Jul. 14, 1998

[54] SHADED LOGOS FOR GOLF BALLS

[75] Inventors: Kathryn M. Mello, East Wareham; Matthew M. Semiao, North Dartmouth, both of Mass.

[73] Assignee: Acushnet Company, Fairhaven, Mass.

[21] Appl. No.: 874,925

[22] Filed: Jul. 8, 1997

Related U.S. Application Data

[63] Continuation of Ser. No. 511,204, Aug. 4, 1995, abandoned.

[51] Int. Cl.[6] ..... B41F 31/00; A63B 43/00

[52] U.S. Cl. ..... 101/494; 473/200; 473/353; 40/327; 101/32; 101/35; 101/DIG. 40; D3/255

[58] Field of Search ..... 101/494, 32, 35, 101/483; 473/328, 200, 353; 40/327

[56] References Cited

U.S. PATENT DOCUMENTS

| | | | |
|---|---|---|---|
| 906,932 | 12/1908 | Riblet | 40/327 |
| 4,441,716 | 4/1984 | Chen | 473/237 |
| 4,644,392 | 2/1987 | Yamada | 358/75 |
| 4,803,922 | 2/1989 | Dennesen | 101/41 |
| 4,808,018 | 2/1989 | Robertson et al. | 101/3.1 |
| 4,924,301 | 5/1990 | Surbrook | 358/534 |
| 5,013,046 | 5/1991 | Koch | 473/200 |
| 5,074,206 | 12/1991 | Edwards | 101/211 |
| 5,087,049 | 2/1992 | Yamagishi | 40/327 |
| 5,123,345 | 6/1992 | Wood | 101/38.1 |
| 5,143,377 | 9/1992 | Oka et al. | 40/327 |
| 5,192,079 | 3/1993 | Sun et al. | 40/327 |
| 5,233,366 | 8/1993 | Stephany | 358/298 |
| 5,248,878 | 9/1993 | Ihara | 219/121.69 |
| 5,388,517 | 2/1995 | Levien | 101/485 |
| 5,416,848 | 5/1995 | Young | 395/141 |
| 5,461,703 | 10/1995 | Goyins et al. | 395/109 |
| 5,503,699 | 4/1996 | Ratner et al. | 40/327 |
| 5,510,910 | 4/1996 | Bockman et al. | 358/502 |
| 5,537,921 | 7/1996 | Adner et al. | 101/35 |
| 5,542,680 | 8/1996 | Proudfit et al. | 473/378 |
| 5,569,418 | 10/1996 | Russo, Sr. | 264/36 |
| 5,577,179 | 11/1996 | Blank | 395/135 |
| 5,579,117 | 11/1996 | Arsenault et al. | 358/296 |
| 5,634,399 | 6/1997 | Pepin et al. | 101/483 |
| 5,697,715 | 12/1997 | Kuroda | 102/DIG. 40 |

*Primary Examiner*—Eugene H. Eickholt
*Attorney, Agent, or Firm*—Pennie & Edmonds LLP

[57] ABSTRACT

This invention relates to novel shaded logos for use on golf balls, golf balls having said novel shaded logo designs printed on their surface and methods of adding shaded logos to golf balls.

18 Claims, 6 Drawing Sheets

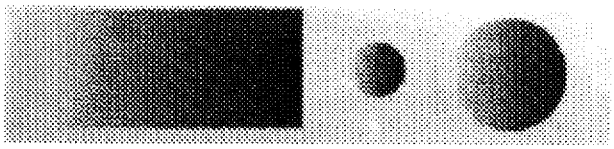
0 degree gradient FIG. 3A
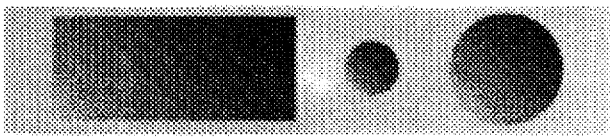
45 degree gradient FIG. 3B
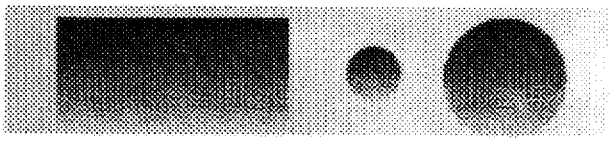
90 degree gradient FIG. 3C
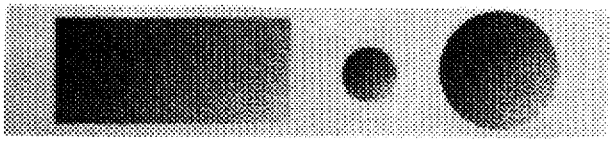
135 degree gradient FIG. 3D
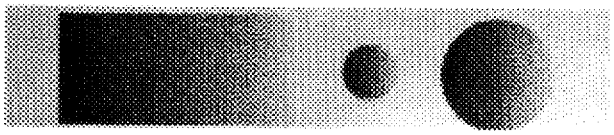
180 degree gradient FIG. 3E

50% OPACITY

50% OPACITY-NORMAL LINEAR GRADIENT

50% OPACITY- 30% RADIAL OFFSET RADIAL GRADIENT

50% OPACITY

50% OPACITY-NORMAL LINEAR GRADIENT

50% OPACITY- 30% RADIAL OFFSET RADIAL GRADIENT

50% OPACITY

50% OPACITY-NORMAL LINEAR GRADIENT

50% OPACITY- 30% RADIAL OFFSET RADIAL GRADIENT

50% OPACITY

50% OPACITY-NORMAL LINEAR GRADIENT

50% OPACITY- 30% RADIAL OFFSET RADIAL GRADIENT

50% OPACITY

50% OPACITY-NORMAL LINEAR GRADIENT

50% OPACITY- 30% RADIAL OFFSET RADIAL GRADIENT

50% OPACITY

50% OPACITY-NORMAL LINEAR GRADIENT

50% OPACITY- 30% RADIAL OFFSET RADIAL GRADIENT

SHADED LOGOS FOR GOLF BALLS

This application is a continuation application of application Ser. No. 08/511,204, which was filed on Aug. 4, 1995, now abandoned.

BACKGROUND OF THE INVENTION

1. Field Of The Invention

This invention relates to novel shaded logos for use oh golf balls, golf balls having said novel shaded logo designs printed on their surface, and methods of adding shaded logos to golf balls.

2. Description Of The Prior Art

More than five hundred million golf balls are produced each year. Of this number, a significant percentage, have some type of decorative logo printed on their outer surface designed to, for example, advertise or identify a particular corporate entity, golf course, club, or resort.

Two different approaches are currently used to add logos to the dimpled surface of golf balls. The first approach is to add a decal to the spherical ball surface and then spray the golf ball cover with a clear finish. This decal process is limited in several different ways. First, decals are usually purchased by the golf ball manufacturer from a vendor. Defective or off color decals must be sent back to the decal vendor and can cause delays in providing customers with orders within a competitive time frame. Further, decals are expensive and the material and labor costs for adding decals to the dimpled surfaces of golf balls averages four to seven times that to pad print logos onto a golf ball. Also, the variety of colors and the shading of those colors can be limited by the manufacturing process of decals. Decals are made using a silk screening process which by its nature inhibits the use of shading.

The other approach to adding a logo to a golf ball is pad printing. Pad printing is an indirect intaglio process. Depressions are created in a flat block called "the plate" or pad printing cliche. The depressions are filled with ink and a smooth, resilient stamp block of silicone rubber takes up ink from the plate, and transfers it to the golf ball. The stamp block is termed a "pad" and it is this term that has lent its name to the printing process.

The pad printing process begins by spreading ink across the surface of a plate using a spatula. The ink is then scraped back into the ink reservoir using a doctor blade which leaves ink in the depressions on the plate. Thinner evaporates from the ink lying in these depressions and the ink surface becomes tacky. As the pad passes over the depressions, ink will stick to the pad. As the pad lifts, it takes with it not only the tacky, adhering film, but also some of the more fluid ink underneath. This film of ink is carried to the target area on the dimpled golf ball surface. On the way, more of the thinner evaporates from the exposed, surface of the ink on the silicone pad, and the ink surface facing away from the pad becomes tacky. As the pad is applied to the golf ball, the film of ink sticks to the ball surface, and separates from the pad as it is raised.

The pad printing process of adding logos to golf balls, which is used as an alternative to the decal method, requires less time and is less expensive than the decal method but is still beset with problems. For example, most pad printing, machinery for use in the printing of golf balls is designed to employ a set number of colors, i.e., 2, 4, 6, or 8. In traditional pad printing methods the number of colors is usually equal to the number of wells which are used to apply the ink to the plate. Thus, where there are two shades of the same color, two inks and two ink wells are needed to apply the different shades to a golf ball. When a manufacturer receives an order for logos having more color than their pad printing equipment is designed to handle, they must either buy new equipment or turn down the order for that logo.

As a result of these problems there exists a need in the golf ball art for a process of adding multiple colors or shading to logos used on golf balls.

SUMMARY OF THE INVENTION

This invention is directed to a method of adding a multiple colored logo or shaded logo to the dimpled surface of a golf ball.

This invention is also directed to a golf ball having a shaded logo on its surface.

The present invention is further directed to a method of adding a shaded or multicolored logo to a golf ball comprising the steps of: a) forming a pattern or logo comprising more than one region on a pad printing cliche wherein each region comprises a plurality of depressions of substantially uniform depth, the size of the depressions being the same and the depressions being randomized and wherein there are at least two regions in which the distance between the depressions making up the region is not the same to create a shading effect, and wherein the combination of different regions form the logo or pattern; b) using the pad printing cliche of step A to add a logo or pattern to a golf ball.

BRIEF DESCRIPTION OF THE DRAWINGS

FIGS. 3A–3C are a representation of various shading effects in which the pixels forming the grey scale have a gradient in a particular direction.

DETAILED DESCRIPTION OF THE INVENTION

Figure 1:
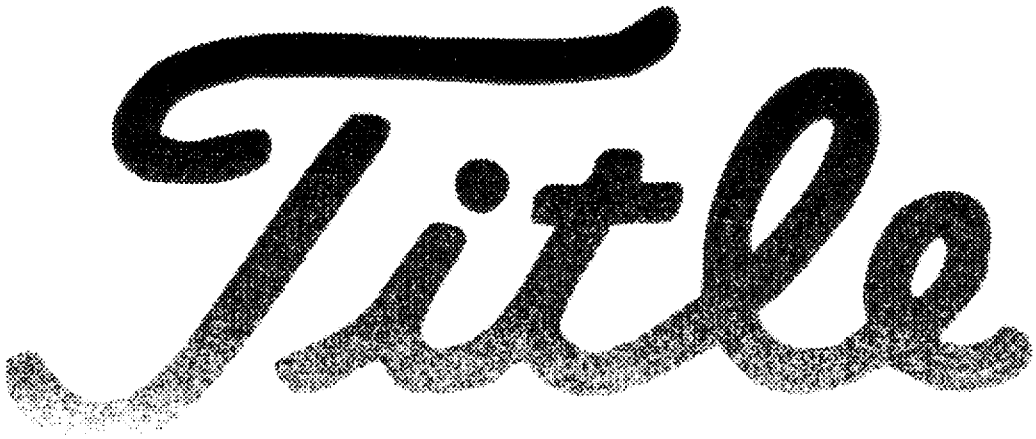
FIG. 1 is a representation of a logo or pattern to be used according to the present invention, wherein the pixels forming the logo or pattern have been randomized to create a shading effect.
Figure 2:
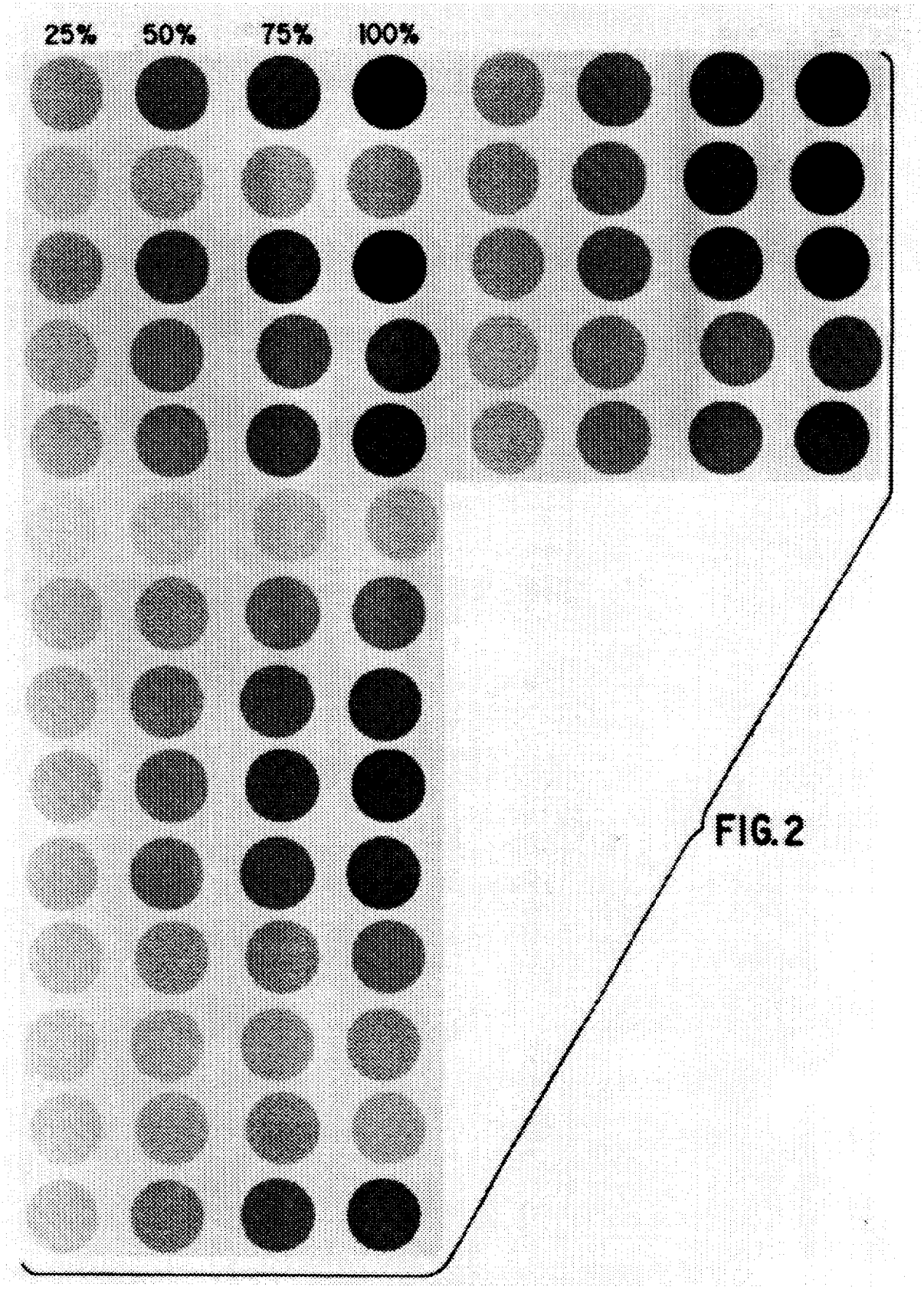
FIG. 2 is a representation of various shading effects made up of pixels forming a gray scale.
Figure 4A:
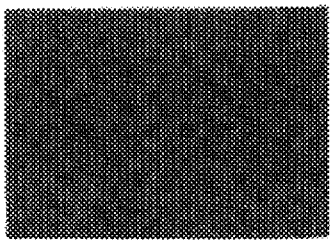
FIGS. 4A–4C are a representation of various shading effects one or more of which illustrates a radial shading effect.
Figure 4B:
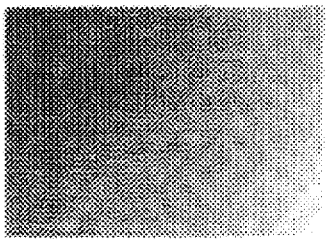
Figure 4C:
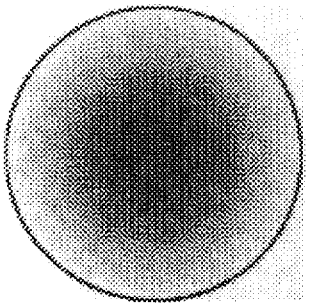
Figure 5A:
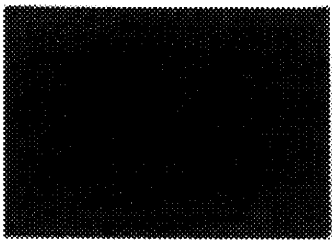
FIGS. 5A–5C are a representation of various shading effects showing a gray scale output, one or more of which illustrates a radial shading effect.
Figure 5B:
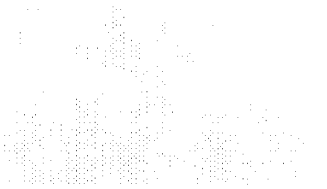
Figure 5C:
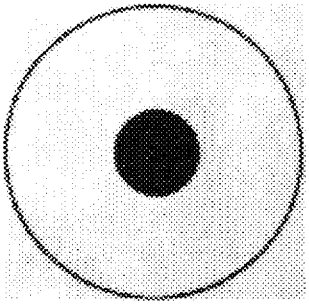
Figure 6A:
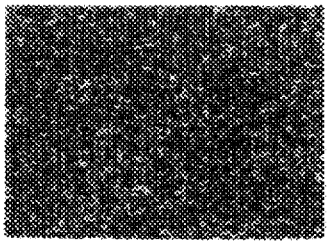
FIGS. 6A–6C are a representation of various shading effects showing a 50% threshold pattern, one or more of which illustrates a radial shading effect.
Figure 6B:
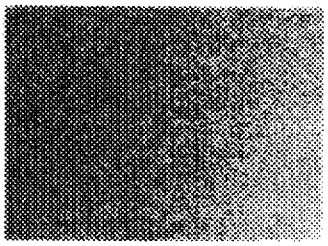
Figure 6C:
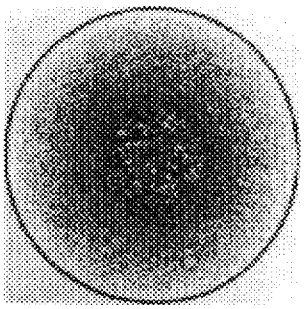
Figure 7A:
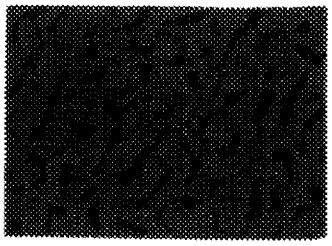
FIGS. 7A–7C are a representation of various shading effects showing a custom pattern fill—with 50% of opacity pattern, one or more of which illustrates a radial shading effect.
Figure 7B:
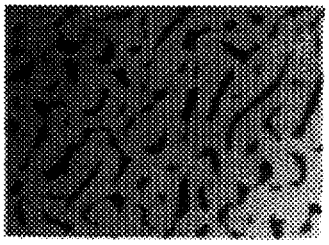
Figure 7C:
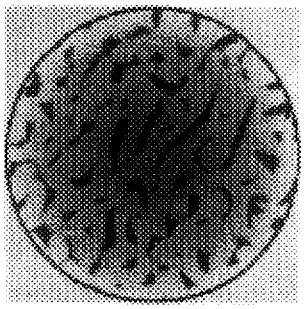
Figure 8A:
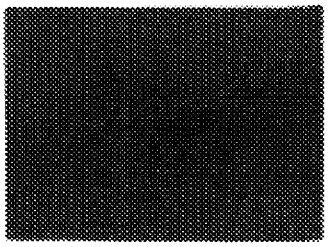
FIGS. 8A–8C are a representation of various shading effects showing a pattern dither pattern, one or more of which illustrates a radial shading effect.
Figure 8B:
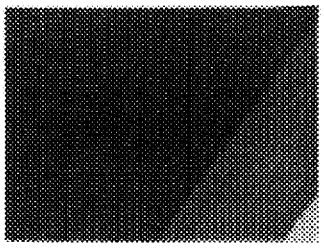
Figure 8C:
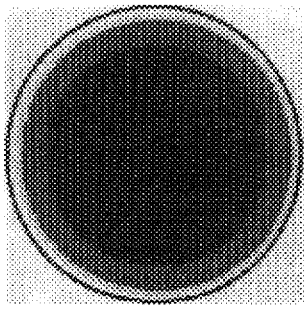
Figure 9A:
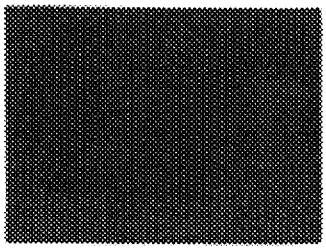
FIGS. 9A–9C are a representation of various shading effects showing a halftone screen pattern, one or more of which illustrates a radial shading.
Figure 9B:
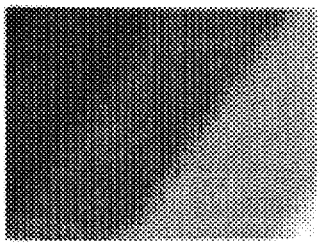
Figure 9C:
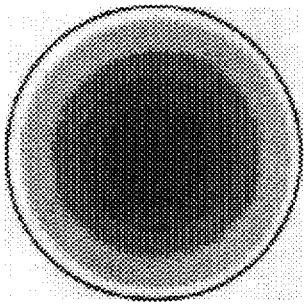

Pattern or logo are the same for purposes of this invention and are considered to mean any symbol, letter, group of letters, design, image, etc. that can be added to the dimpled surface of a golf ball.

Shading is meant to encompass those circumstances where the intensity of a particular color is gradually reduced by reducing the number of pixels of that color. The term region as used herein means an area of pixels having substantially the same size, having equidistant centers from one another, or having substantially the same gradient. Gradient refers to the rate of change in distance between pixels.

The term pixel is herein defined as any of the small discrete elements that together constitute an image. For purposes of this invention the pixels can be any shape, regular or irregular, such as, for example, circular, elliptical, rectangular, square, triangular, polygonal, to name but a few. Irregular shapes are those which have a continuous boundary but lack symmetry. Further, the size of the pixels may be any size capable of being printed and which is suitable for use on the spherical dimpled surface of a golf ball. These sizes include from about 10 microns to about 1 millimeter, or more preferably, from about 50 microns to about ½ millimeter.

The distance between pixels can be any distance which will serve to distinguish pixels of different regions of a pattern or a logo from each other or to create a shading effect. The present invention is directed to logos or patterns which appear on golf balls and which incorporate a plurality of different colors and/or a shading effect in all or part of the design. In a preferred embodiment of the present invention, a shading effect is randomized through use of a bit map transformation. Randomization is the removal of a predetermined percentage of random pixels from the shaded area in an amount sufficient to provide a clear depiction of the image. The predetermined percentage of pixels can be any percentage that when removed the image will still be apparent. This range of percentages is meant to include from about 5% to about 99% or more preferably from about 20% to about 99%. This enables a clear representation of the image appearing as the logo with fewer pixels than through use of a solid color or a grey scale shading process, for instance.

In the most preferred embodiment of the present invention an image is added to a computer memory, the image is converted to grayscale and then the image is converted using standard computer techniques for changing images based on how pixels appear. A grayscale image consists of various levels of gray. Depending on the number of bits of information saved when the image was scanned, a grayscale image can contain up to 256 levels of gray. Gray levels can range from 0 (black) to 255 (white). It is possible to convert both bitmapped and color images to gray-scale images.

For purposes of the present invention the term bitmap means images that consist of one bit of color (color or white) per pixel and require the least amount of memory of all image types. Because few editing options are available: in bitmap mode, it's usually best to edit the image in grayscale mode and then convert it to bitmap mode if necessary to export the image to another application. To convert a color image to a bitmapped image, you must first convert it to a grayscale image. This removes the hue and saturation information from the pixels and leaves the brightness values.

There are numerous selections within a bitmap conversion that are useful according to the present invention. It is possible to select any one of at least five options when you convert a grayscale image to a bitmap image. The options determine the quality of the bitmapped image, ranging from a high contrast image to a textured or halftone screen effect for output on non-PostScript® language printers.

The 50% Threshold option converts pixels with a gray value above the middle gray level (128) to white, and it converts pixels below the middle gray level to black. The result is a high-contrast, black-and-white representation of the image.

The Pattern Dither option uses an error-diffusion process to convert the image. The program starts at the pixel in the upper left corner of the image and evaluates its gray-level value. If the value is above middle gray (128), the pixel is changed to white. If the value is below 128, the pixel is changed to black. There is some error in the conversion because the original pixel is usually not pure between black and white, and the conversion changes it to either a black or a white value. The amount of error is transferred to surrounding pixels before they are converted. In this way, the error is diffused throughout the image. The result is a grainy, film-like texture. This option is useful for viewing images on a black-and-white screen.

The Halftone Screen option simulates the effect of printing a grayscale image through a halftone screen. The screen frequency is the ruling of the half-tone screen. The frequency depends on the paper stock and type of press used for printing. Newspapers commonly use an 85-line screen. Magazines use higher resolution screens, such as 133 and 150. Values can range from −180 to +180. The screen angle refers to the orientation of the screen. Continuous-tone and black-and-white halftone screens commonly use a 45-degree angle.

The Custom Pattern option in the bitmap dialog box simulates the effect of printing a grayscale image through a custom halftone screen. This method allows you to apply a screen texture such as a wood grain, to an image.

You can create a pattern that represents the texture you want and then screen the grayscale image to apply the texture to the image. If you want the pattern to cover the entire image, create a pattern that is as large as the image; otherwise, the pattern will be tiled. For example, if you apply a 1-inch by 1-inch pattern to an image that is 4 inches by 4 inches, the pattern appears as 16 squares.

The Adobe Photoshop® software contains several self-tiling patterns that can be used as halftone screen patterns.

The Custom Pattern option simulates dark colors by making the halftone pattern thicker, and simulates light colors by making the halftone pattern thin. Choose a pattern that lends itself to these variations; such a pattern typically has a variety of gray shades.

Another way to prepare a black-and-white pattern for conversion is to convert the image to grayscale mode and then apply the Blur More tilter to the pattern several times. This technique blurs the lines within the pattern, creating thick lines that taper from dark gray to white. The Custom Pattern option can then use this pattern to effectively screen both the light and dark areas of the image.

The present invention involves the formation of an image comprising a plurality of discrete elements which together form different regions of the image.

The shaded logo of the present invention can be created according to any method. However, it is preferred that the logo be created by adding a logo to a computer memory so that the logo can be manipulated on the computer using various off the shelf computer programs such as "Adobe Photoshop®" and "Adobe Illustrator®". In particular, a piece of art work provided by a custom ball client can be scanned into computer memory using any of the numerous means of scanning a document onto a computer memory. Alternatively, the logo or pattern may be created in computer memory by using a program to draw the logo onto the system. Once the logo is in computer memory, the logo is cleaned up, for example, to make lines continuous or discontinuous and regions distinct. The various regions making up the logo are then separated and assigned different colors and/or shading effects.

Once the image of the logo or pattern is contained in the computer the different areas of the logo are broken up into regions and each region is assigned a color and/or a gradient of a color. This gradient of color comprises a number of pixels of a given shape and size.

The logo can then be added to a medium which can serve as a positive for addition of the logo to a pad printing cliche or plate. The preferred medium are transparent films such as an acetate film for example.

The image on the positive can then be transferred to a pad printing cliche or plate. This procedure may be accomplished using any means known to the skilled artisan. It can even be accomplished by having an artist etch the image into the plate without the use of a positive or a negative. However, when employing a plate the most facile method of adding depressions to the plate is by using some type of radiation curable polymer.

A case-hardened and lapped steel plate can be used for, long runs and for precision work. For such work, a plate can be provided with a photosensitive coating. A film positive containing the shape of the image to be printed is then laid on this coating, and exposed. Radiation, such as U.V. light causes the photosensitive layer to become hard. The parts covered by the film remain soft and can be removed in a developing bath. The image to be printed is thus revealed on the plate and can be etched using a etching bath with, for example, nitric acid, ferric chloride or other suitable substances. For very fine lettering the etch-depth can be from about 10 μm to about 30 μm.

For short runs it is not necessary to use steel plates and it is possible to use both non-radiation curable polymers and/or radiation curable photopolymer plates. Treated carefully, photopolymer plates can produce several thousand impressions. A metal backing plate is coated with a photosensitive polymer which can polymerize under the action of radiation such as U.V. light, and becomes hard. The photosensitive layer may be made of any polymer material suitable for curing with radiation. Suitable polymers include polyester, nylon, acrylate class polymers, etc. and are known in the art. Plates having a polymer layer thereon are commercially available. If a film positive having the shape of an image to be printed, is laid on the plate following exposure, the parts of the layer covered by the image remain soft. By then placing a screen film with clear spots in position and exposing again, these spots on the plate also harden. After treatment with a suitable developer, there remain small truncated cone shapes which prevent the doctor blade from spreading ink unevenly. Nylon plates should always be screened.

According to the present invention, creating the plate is accomplished by situating the positive containing the image of the logo, over a blank plate. Any plate capable of accepting an image and performing as a pad printing cliche can be used according to the present invention. The preferred plate is a 3"×4" metal plate coated with a polymer surface, available, for example, from Pitman Corporation of Taunton, Mass. as a Torelief W5-43A II.

When the positive of the logo is situated above the late, ultra violet light is introduced to the surface of the late that is not covered by the logo. In a preferred mode of the present invention, U.V. light is supplied by a plate exposure unit such as those available from Jet U.S.A. Corp. of Collingdale, Pa. as Jet Model JE-A3-FF or a Transtech America, Inc. exposure units such as model #M10355 or 142202. The plate and logo may be exposed to U.V. light for any period sufficient to harden the polymer coated surface of the plate which is subjected to the U.V. light. A preferred exposure period is from about 1 second to about 4½ minutes; or, more preferably for a period of from about 15 seconds to about 3 minutes. The most preferred exposure period is 40 seconds.

Often, after an initial exposure period the logo and plate are completely covered with a screen film. If the printed areas are large the doctor blade may drop into the depression. The ink left on the plate is then unevenly distributed. Also, the rolling motion of the pad can squeeze the ink layer as it picks up the ink, resulting in an irregular image when the ink is transferred. To eliminate this problem, large printed areas are screened. After etching, these large areas are left with projections shaped like small truncated cones, and these have the following advantages.

The screen film can have 80 lines/cm. This therefore produces 64 small circular surfaces per $mm^2$, each with a diameter of 0.02 to 0.03 mm. This also explains why only high-quality, fine grained material can be used for making the plates. The quality and sharpness of the printed image are still maintained, as the screen spots show very slightly at the edges.

The screen film can have frames of about 50 to about 1,000 lines per inch or, more preferably, from about 100 to about 300 lines per inch. It is most preferred to employ a screen having approximately 200 lines per inch. With the screen completely covering the logo and plate, an additional exposure to ultra violet light can occur. The purpose of this screening effect is to create a series of rises within the depression forming an image that will prevent the doctor blade from spreading ink unevenly.

The second dosage of ultra violet light can be for a period of from about 1 second to about 4½ minutes, or more preferably, from about 1 second to about 1 minute. After exposure to two separate doses of U.V. light the plate can be washed to remove that polymer on its surface that was not hardened through exposure to U.V. light. The removal of such uncured polymer can be accomplished by any method. However, it is preferred that the uncured polymer be removed using water. Apparatus for removing uncured polymer are commercially available from Jet U.S.A. Corp., Collingdale, Pa. as Jet Model JW-A3-50 or from TransTech America, Inc. as Models M10627 and washing tray Pt #M10643. Excess water can be removed from the plate using compressed air.

Upon drying, the plate or cliche is heated to a temperature sufficient to remove all water from the cliche. The cliche can be heated to 50° C. or higher for a period of from about ten minutes to about 5 hours in an oven to harden the polymer coating on the cliche.

When heat treatment is completed, the cliche is again exposed to U.V. light for a period of from 4 minutes to 5 hours or more, preferably from about 4 minutes to about 1 hour.

While the above-described process describes one method of preparing the cliches which are used to transfer the ink to the spherical dimpled surface of a golf ball there are numerous other methods, well known to the person of ordinary skill in the art that can be used to perform the same function.

Pad printing cliches made according to the aforementioned procedure can be used in a pad printing machine to print logos onto the dimpled surface of golf ball using machines such as the Inkflex IF 25–50 or the Teca Print®

TP-100. The TP-100 is also capable of printing two-color logos. The operating speed for one color is 30 piece per minute and 21 pieces per minute for two-color work. Three and four color logos can be printed on balls using the Teca-Print® four color machines. These are custom designed machines in which the operator must place balls into ball holding fixtures located on an indexing oval "carousel" conveyor. There are multiple ball holding fixtures located on the oval track. The basic design of the machine is two Teca-Print® TPX-100 two-color machines integrated with a Teca-Print® pneumatic transfer carousel 14—station, 4½" indexing system. These systems can be run at 19 pieces per minute.

Any type of ink may be used in the printing process of the present invention. It is possible to use one-component inks because their long pot life can make them easier to work with and more economical. Some one-component inks are highly resistant to abrasion and solvents. Curing can take place physically or by oxidation.

Two-component inks may also be used to meet stringent requirements regarding mechanical wear and durability. Physical drying, i.e., evaporation of the thinners, can be followed by a chemical reaction. Curing is largely complete after six days.

Ultraviolet ink can also be used in the present invention. UV inks are typically cured by means of UV light having wavelengths of from about 180 to about 380 nm. The molecules then link up to form macromolecules.

The advantages of using a U.V. ink are that they are fast and thorough curing; the ink does not dry up (constant viscosity); they use smaller amounts of combustible organic solvents; and little or no solvent fumes escape into the working environment.

The ink may optionally contain additives such as: binders; reactive prepolymers; thinners; low-viscosity mono and poly-functional monomers; photoinitiators to stimulate polymerization; stabilizing additives, flow control agents, wetting agents, pigments and extenders.

The thickness of the ink film transferred to a golf ball can be any thickness that is sufficient to provide a clear image of the logo. This thickness can be between 4 and 50 μm, preferably from about 4 to about 20 μm. The thickness of the ink film can vary with the ink type and color, and is also influenced by the ink's viscosity, the pad material, the depth of etching in the plate and also environmental factors such as temperature, humidity, and so on.

After the printing process is complete, the golf balls are removed to a dry room to finally cure the ink used for the logo. The dry room is maintained at an elevated temperature to aid in drying the logo ink. The dry room is typically kept at 50° C. and the balls are usually kept in the dry room for approximately four hours.

EXAMPLES

In order to exemplify the results achieved using the graphic shading process of the present invention, the following examples are provided without any intent to limit the scope of the present invention to the discussion therein, all parts and percentages are by weight unless otherwise indicated.

Example I

A logo having a plurality of different colors is scanned into the Graphic System's "Adobe Photoshop®" software on a MacIntosh® computer. Basic "clean-up" of the artwork is performed and then the "Adobe Streamline" software is used to outline areas of the logo requiring color separation. After the image is streamlined it is moved into the "Adobe Illustrator®" software. The different colors of the logo are separated and those areas of the logo to be shaded are selected and assigned a percentage of tint. At this point the image is saved.

The saved image is added to the "Photoshop®" software where the "Gradient" tool is selected and used to alter the previous tinted images to create the desired transition from light intensity to dark intensity.

The completed logo is then printed on to a clear positive through the Linotronic processor. The clear positive is used to make a plate using a photo sensitive polymer material on a water wash. The plate is then set-up on a pad print machine with the specified inks. The logo having a plurality of colors is then added to golf balls using a standard pad printing process.

Example II

A piece of logo artwork is scanned into the computers memory via a flat bed desk top scanner. Scanned images are manipulated (cleaned-up/modified) in Adobe Photoshop® and Adobe Streamline. Gradients and tints are applied within Photoshop® or Illustrator® or both. Screen tints/gradients may be applied to one color logos and multicolor logos.

Artwork can also be created directly in Illustrator® or Photoshop® (object incapable of being scanned or artwork impractical to scan). Once created, a tint/gradient can be applied via the tools available within the software package chosen. All computer artwork is outputted to film (positive) using a high resolution Linotype-Hell® L-330 laser-imagesetter. Output resolution is 1270 dpi. The film is processed through a standard rapid access film processor.

Example III

The film positive is positioned on a Torelief® WS-43H II, light sensitive water washable photo polymer plate material available from Pitman Company, of Taunton, Mass. in a Jet Model JE-A3-SS UV plate making exposure unit available from Jet, U.S.A. Corp., of Collingdale, Pa. and exposed to U.V. light for a period of 40 seconds. A Teca Print® screen is then placed over the plate and the plate is again exposed to U.V. light for a period of 16 seconds. The plate is then washed with water for 15 seconds to remove uncured polymer in a Jet Model JO-A3 available from Jet, USA Corp., Collingdale, Pa. The plate is next baked for a period of approximately 10 minutes at 50° C. in a Jet Model JW-A3-SD heating unit by supplier Jet U.S.A. Corp., of Collingdale, Pa., oven to receive all moisture. Finally, the plate is hardened by post-exposing the plate to UV light for 4 minutes in BASF Mini II system (exposure unit only) from BASF®, New Jersey.

Example IV

The protective film is removed from an AQUA-NYLON cliche.

The film positive containing all or part of the image to be printed is placed emulsion to emulsion on the cliche surface. Agfa Gavaert, Gevaline Ortho L715 pm. mat film is used as there is little or no trapping of air.

The ACUA-NYLON cliche is exposed to U.V. light for 4 minutes in a TRANS TECH Exposure Unit (Pt. #M10355 or 142202). The exposed area of the cliche is thereby hardened.

As each particle of dust causes an exposed spot, all cliches and film surfaces are cleaned of all dust.

The line film is removed and the screen film having 200 Line/inch screen for surfaces requiring good color density (Pt. #330023) is situated over the complete cliche surface.

The screen film covered cliche is exposed in a TRANS TECH Exposure Unit for 4 minutes. Surfaces are maintained dustless.

The AQUA-NYLON Cliche is subsequently washed out with water having a temperature of from about 20°–25° C. The wash out is performed by hand using hand brush (Pt. #M10627) and washing tray (Pt. #M10643). Washing time is approximately 2½ minutes. After the washout process, the cliche is washed off with clean water and excess water is carefully removed with compressed air.

For complete hardening, the AQUA-NYLON cliche is baked in a hot air cabinet for 30 minutes at 140° F.

After the baking process, the cliche is again exposed in the Exposure Unit for 4 minutes. The cliche is now ready to print.

Example V

One color logos are printed onto a golf ball. The operators place a ball in a stationary ball holding fixture located under the pad print head; the Inkflex IF 25–50 pad printing machine is actuated to print the ball (one cycle of the machine) via the ink-pad transfer process.

The scope of the following claims is intended to encompass all obvious changes in the details, materials, and arrangement of parts that will occur to one of ordinary skill in the art:

We claim:

1. A golf ball having a logo comprising:

a) a golf ball cover;

b) a logo formed on the cover comprising more than one region wherein each region comprises a plurality of randomized pixels wherein there are at least two regions in which the distance between the center points of the pixels making up the regions are not the same and wherein the combination of the regions form the logo.

2. The golf ball according to claim 1 wherein the pixels are spaced in a manner such that there is a rate of change in spacing between pixels that is constant in a linear direction within the logo to create a shading effect.

3. The golf ball according to claim 1 wherein the pixels are spaced in a manner such that there is a rate of change in the spacing between the pixels that is constant in a radial direction to create a shading effect.

4. The golf ball according to claim 1 wherein the pixels are spaced in a manner such that there is a rate of change in the spacing between the pixels that varies to create a shading effect.

5. The golf ball according to claim 1 wherein the pixels do not have a uniform shape.

6. The golf ball according to claim 1 wherein the pixels have a shape selected from the group of circular, rectangular, polygonal and elliptical shape.

7. The golf ball according to claim 1 wherein the pixels create a multicolored logo.

8. A golf ball having a logo printed on an outer, dimpled surface, wherein the logo comprises a plurality of regions, each region comprising a plurality of pixels of uniform shape and in which the centers of the pixels are randomly spaced from each other and at least two regions have different spacing between pixels wherein the combination of different regions form the logo and create a shading effect.

9. A golf ball according to claim 8 wherein the pixels are spaced such that spacing between pixels changes at a rate that is constant to create a shading effect.

10. A golf ball according to claim 8 wherein the pixels are spaced such that spacing between pixels changes at a rate that varies to create a shading effect.

11. The golf ball according to claim 8 wherein the pixels create a multicolored logo.

12. A golf ball having a shaded logo, comprising:

a) a cover with a plurality of dimples thereon;

b) a logo printed on the cover;

1) the logo comprising a plurality of regions, each region comprising a plurality of ink pixels;

2) the number of the ink pixels in each region being reduced from the number of pixels in the adjacent region to create a shading effect.

13. The golf ball of claim 12 wherein each of the ink pixels has a diameter in the range of about 10 microns to about 1 millimeter.

14. The golf ball of claim 13 wherein a first region has a predetermined percentage of ink pixels compared to a second region to create a shaded area.

15. The golf ball of claim 14 wherein the predetermined percentage is in the range of about 20% to 99%.

16. The golf ball of claim 12 wherein the ink pixels contain one or more additives selected from the group of binders, reactive prepolymers, thinners, low-viscosity mono and poly-functional monomers, photoinitiators, stabilizers, flow control agents, wetting agents, pigments and extenders.

17. The golf ball of claim 12 wherein the ink pixels have a thickness of about 4 to 20 μm.

18. The golf ball of claim 12 wherein there are more than one color of ink pixels.

* * * * *